US005224545A

United States Patent [19]

George et al.

[11] Patent Number: 5,224,545

[45] Date of Patent: Jul. 6, 1993

[54] ECCENTRICALLY ACTUATED PERFORATING GUNS

[75] Inventors: Flint R. George, Katy; Henry L. Restarick, Plano; David T. Merritt, Aubery, all of Tex.

[73] Assignee: Otis Engineering Corporation, Carrollton, Tex.

[21] Appl. No.: 867,041

[22] Filed: Apr. 10, 1992

[51] Int. Cl.[5] ..... E21B 23/02; E21B 43/117

[52] U.S. Cl. ..... 166/297; 166/55.1; 166/117.5

[58] Field of Search ..... 166/297, 55, 55.1, 117.5, 166/117.6; 175/4.51

[56] References Cited

U.S. PATENT DOCUMENTS

| | | | |
|---|---|---|---|
| 2,452,920 | 11/1948 | Gilbert | 166/297 |
| 4,269,278 | 5/1981 | Vann | 175/4.51 |
| 4,397,355 | 8/1983 | McLamore | 166/297 |
| 4,410,051 | 10/1983 | Daniel et al. | 175/4.51 |
| 4,416,330 | 11/1983 | Merritt et al. | 166/117.5 |
| 4,440,222 | 4/1984 | Pullin | 166/117.5 |
| 4,524,833 | 6/1985 | Hilts et al. | 166/381 |
| 4,673,036 | 6/1987 | Merritt | 166/117.5 |
| 4,685,523 | 8/1987 | Paschal et al. | 166/378 |
| 5,033,550 | 7/1991 | Johnson et al. | 166/117.5 |

*Primary Examiner*—William P. Neuder
*Attorney, Agent, or Firm*—Dennis T. Griggs

[57] ABSTRACT

A perforating gun is supported from the lower end of a side pocket mandrel. The perforating gun includes a mechanical detonator which is received within the side pocket receptacle bore. The mechanical detonator is actuated in response to striking engagement by a kick-over tool. The side pocket mandrel includes a longitudinal production bore which is connected in alignment with a string of production tubing. The perforating gun assembly is run in with the production tubing during initial installation of isolation packers, and the shoot is carried out while the well bore is in an underbalanced pressure condition.

6 Claims, 4 Drawing Sheets

ECCENTRICALLY ACTUATED PERFORATING GUNS

FIELD OF THE INVENTION

This invention relates generally to well completion apparatus, and in particular to well casing perforating apparatus which is shot while the well is in an underbalanced pressure condition.

BACKGROUND OF THE INVENTION

Oil and gas wells are completed with a string of tubular steel casing which is cemented in place. When properly placed and cemented in the well bore, the casing protects freshwater reservoirs from contamination, supports unconsolidated rock formations, maintains natural separation of formations, aids in the prevention of blowouts and waste of reservoir energy, and acts as a conduit for receiving production tubing through which formation fluids are brought to the surface.

In some wells, the well casing intersects multiple producing formations which are confined vertically between multiple layers of underburden and overburden, typically of impervious siltstone or other barren rock. Consequently, each producing formation must be produced separately. To make this possible, the well casing must be perforated at separate locations which coincide with the separate producing zones. Additionally, the different producing zones must be isolated with respect to each other by packers installed within the casing bore below and above each producing zone.

Gun perforation is a method for providing a well bore reservoir connection by forming holes through the casing and into the surrounding formation. Two conventional perforating methods are bullet perforating and jet perforating. In both methods, the gun is fitted with barrels which contain the perforating apparatus. Each barrel is wired for firing by remote control from the surface. The gun is run into the well bore on a wire line from a service truck. The wire line lowers and raises the gun in and out of the hole, and when the gun is in position to be fired, the operator sends an electric impulse down the wire line to trigger detonation. The bullet or perforating jet punches a hole through the steel casing, the cement sheath, and several inches into the surrounding reservoir, thus creating a flow passage from the reservoir into the well bore. Guns of the bullet type are retrievable and are reloaded at the surface. Many jet type guns are expendable and disintegrate upon detonation, although some types are retrieved and either reloaded or discarded.

After the perforations have been formed, well completion continues with the installation of production tubing, isolation packers, a safety valve, and circulation tools such as sliding side door circulation valves for gas wells, and screens for oil wells.

DESCRIPTION OF THE PRIOR ART

After the casing has been embedded within the formation and the well has been logged to determine the location of one or more producing formations, a perforating gun is suspended from a flexible wire line support cable which is played out from a reel and is supported above the well bore by a rotary sheave. The reel is mounted on a service truck which is equipped with a power hoist for controlling the rate at which the perforating gun is lowered and retracted through the casing bore. When the perforating gun reaches the appropriate depth, an electrical firing signal is conducted to the firing mechanism of the perforating gun by electrical conductors within the support cable. The perforating gun is retrieved to the surface and is reloaded and reinserted into the well bore until the well casing has been perforated in each zone. A conventional hoist and electrical detonator is most commonly used in shallow wells because of the limited length of cable which can be carried on a service truck or service barge.

For deep wells, detonation is obtained by pressurizing the well bore with a non-combustible gas such as nitrogen. One or more perforating guns are run in on a tubing string together with a permanent packer which is set and sealed against the well bore above the lowermost producing formation. Thereafter, additional production tubing strings and packers are run into the well for each producing zone. Each section of production tubing includes a circulation device and one or more perforation guns which are mechanically supported from the production tubing string by a Y block. The well bore above and below each producing zone is sealed by a retrievable packer. Each perforation gun includes a pressure sensitive detonator. According to conventional practice, a foam mixture of nitrogen, surfactant and water is injected into the production tubing at a flow rate of from 4,000–90,000 cubic feet per hour and at a discharge pressure of 10,000 psi. Injection of the nitrogen foam mixture is continued until the pressure within the tubing string and well bore rises to a pressure level which is sufficient to actuate the pressure sensitive detonator, for example, 4,000–5,000 psi.

The foregoing pressure detonation arrangement represents a considerable improvement over the hoist/cable suspended perforation gun system inasmuch as reliable detonation can be obtained at great depths without the need for an electrical cable. Moreover, since the production tubing is in place when the perforations are made, there is no need to kill the well to accommodate trips for retrieval of the perforation gun and insertion of production tubing, circulation tools and packers, which would be required in the use of the hoist/cable supported perforating gun. Moreover, experience has shown that killing a zone may have an adverse affect on production, and that a producing zone which has been killed to accommodate a service operation exhibits substantially reduced production after underbalanced well bore conditions are restored.

An improvement to the use of nitrogen injection and pressurization for initiating detonation is to use a time delay firing head. That is, upon reaching the detonation pressure level, a time delay fuse is ignited and detonation occurs after the elapse of a predetermined interval, for example, 2½–3 minutes. During the time delay interval, the well bore and production tubing are vented, thereby substantially reducing the well bore pressure and reestablishing an underbalanced pressure condition within the well bore prior to detonation.

An underbalanced pressure condition within the well bore is desirable so that a high surge pressure differential will be exerted by the surrounding formation and will clear the perforation tunnels. Upon detonation, shaped charges within the gun explode and produce high temperature, high pressure plasma jets which penetrate the well casing and the surrounding formation. The jet streams punch holes through the well casing and penetrate into the surrounding formation. As a jet stream penetrates the surrounding formation, it compacts the formation, thereby producing a sealed cone which blocks the newly formed casing perforation. When perforating is conducted in an overbalanced well bore condition, fluids, mud and debris from the well bore will be forced outwardly into the formation perforation tunnel and may immediately plug the casing perforation. Experience has shown that as many as 80 percent of the well casing perforations may become plugged by grains of sand, mud, cement cake, pipe dope, and the like which are often abundant in the well at that stage of completion.

Accordingly, it is desirable to perforate the well bore in an underbalanced pressure condition relative to the surrounding formation. Preferably, the nitrogen should be vented from the well bore to produce a pressure differential of at least 5,000 psi or more. With such a high pressure differential, the pressure surge from the surrounding formation will break up the compacted cone and sweep it back into the well bore where it will be flowed to the surface. As the compacted cone fragments are swept away, the casing perforations are cleaned and cleared for maximum inflow. Moreover, mud and debris will also be swept away from the perforation openings and flowed to the surface.

Some of the limitations on using nitrogen injection for obtaining pressure detonation of a perforating gun are the expense of the nitrogen mixture and the length of time required to produce the detonation pressure at depths of 10,000 feet or more. Moreover, nitrogen pressurization service may not be available at a particular location, for example, offshore and in countries which do not produce nitrogen for commercial use.

OBJECTS OF THE INVENTION

The principal object of the present invention is to provide a perforating gun system which can be used at great depths, and which does not require well bore pressurization to obtain detonation.

A related object of the present invention is to provide a well casing perforating gun assembly of the character described which can be run in with production tubing during initial well completion.

Yet another object of the present invention is to provide a well casing perforating gun assembly having a detonator head which is actuated mechanically.

A related object of the invention is to provide a perforating gun assembly of the character described in which the mechanical detonator is protected against inadvertent actuation.

Still another object of the present invention is to provide a perforation gun assembly which can be actuated reliably while the well bore is in an underbalanced pressure condition.

Yet another object of the present invention is to provide a perforating gun assembly of the character described which does not require an electrical cable for detonation.

SUMMARY OF THE INVENTION

The foregoing objects are achieved according to the present invention by a perforating gun assembly which is equipped with a mechanical impact detonator. The perforating gun is attached to the lower end of a side pocket mandrel with the production bore of the side pocket mandrel being coupled to the production tubing. The mechanical detonator of the perforation gun is received within the receptacle bore of the side pocket mandrel. The mechanical detonator includes a firing pin which is engagable by a kickover tool. The kickover tool is run in on a wire line through the bore of the production tubing, and is reciprocated to obtain insertion of the kickover tool into the side pocket receptacle bore for striking the firing pin of the detonator. After detonation, the kickover tool is retrieved from the side pocket, and is thereafter retrieved to the surface.

It will be appreciated that the kickover tool and mechanical detonator can be operated independently of nitrogen injection or pressurization of any kind. Moreover, because the perforating gun is attached to the side pocket mandrel, it can be run in with the production tubing along with isolation packers and other completion tools. Since the kickover tool is supported by a wire line cable, it can be retrieved through the production tubing under sealed conditions and without requiring the well to be pressurized for hydrostatic control purposes. That is, by isolating the producing zones with retrievable packers and by providing that the perforating guns are operable in combination with the installed production tubing, well service operations can proceed without overbalanced hydrostatic protection.

Operational features and advantages of the present invention will be appreciated by those skilled in the art upon reading the detailed description which follows with reference to the attached drawings.

DETAILED DESCRIPTION OF THE PREFERRED EMBODIMENT

Figure 1:
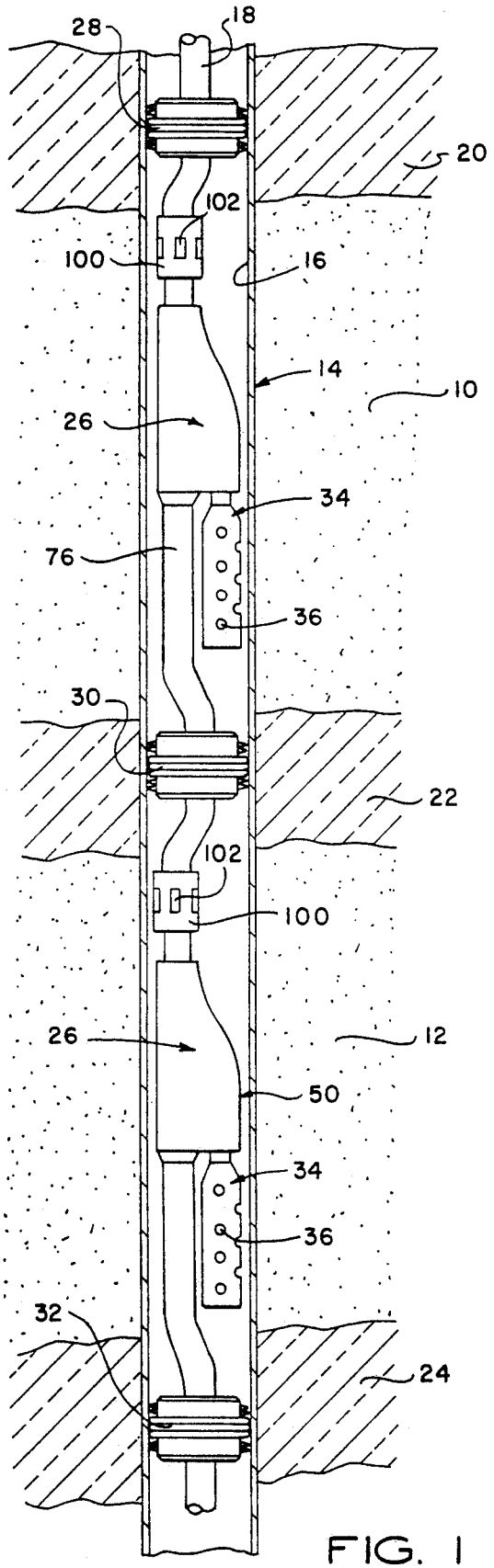
FIG. 1 is a view, partly in section and partly in elevation, showing a typical gas well installation in which the perforating gun assembly of the present invention is installed.

In the description which follows, like parts are marked throughout the specification and drawings with the same reference numerals, respectively. The drawings are not necessarily to scale and the proportions of certain parts have been exaggerated to better illustrate particular details of the present invention.

Referring now to FIG. 1, hydrocarbon formations 10, 12 are intersected by a string of well casing 14. Suspended within the bore 16 of the well casing is a production tubing string 18 which is supported from a surface facility (not shown). The tubular casing string 14 also intersects multiple layers of overburden 20, 22 and 24. The bore of the well casing 14 is sealed by a bottom packer 32 preferably below the lowermost hydrocarbon bearing formation 12.

The hydrocarbon bearing formations 10, 12 are confined vertically between the overburden layers 20, 22 and 22, 24, respectively. The overburden and underburden layers are typically impervious siltstone or other barren rock. For illustrative purposes, the hydrocarbon formation 10 is assumed to be at a depth of 8,500 feet with a gas reservoir pressure of 6,500 psi and a reservoir temperature of 140 degrees F. The hydrocarbon formation 12 is assumed to be at a depth of 12,500 feet with a reservoir pressure of 7,500 psi and a reservoir temperature of 155 degrees F. The overburden layers 20, 22 and 24 are impervious to the flow of gas. Consequently, the producing zone reservoirs 10 and 12 are naturally isolated with respect to each other, and it is therefore necessary to perforate the well casing 14 in each producing zone.

For that purpose, a perforating gun assembly 26 is run into the bore of the well casing 14 on the production tubing string 18 and is suspended at a location coincident with the producing formation. The well bore within each producing zone is isolated from the adjacent zone by retrievable production packers 28, 30 and 32.

Figure 3:
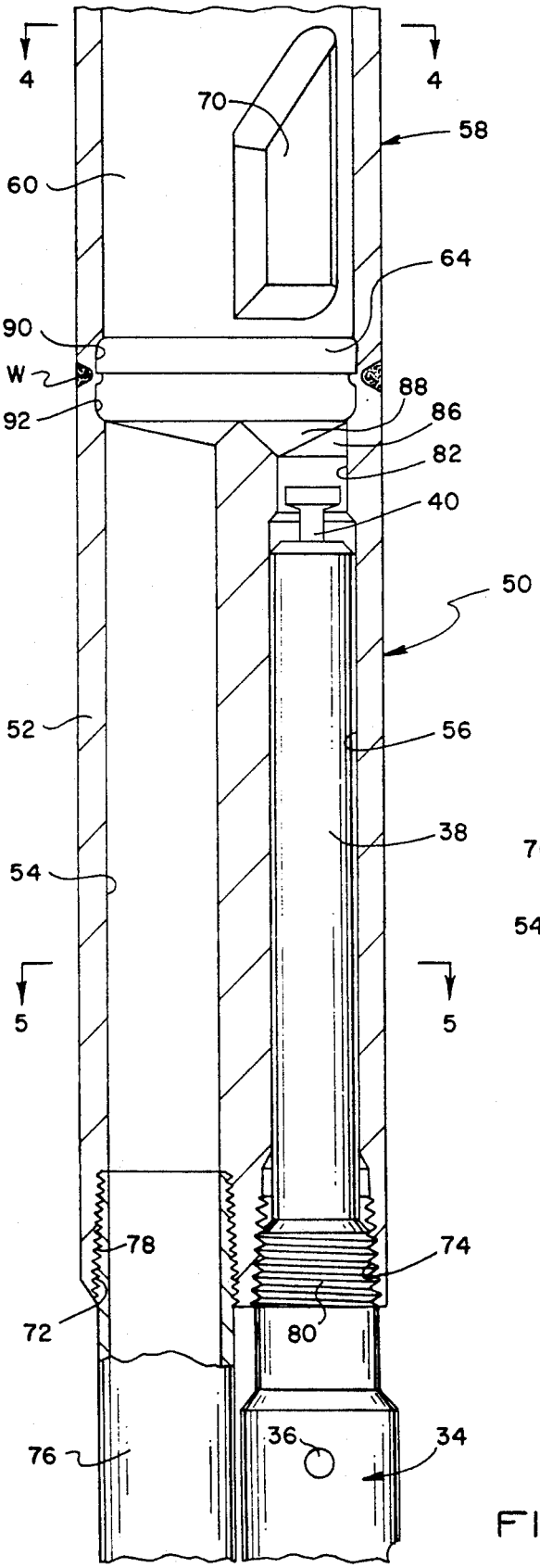
FIG. 3 is an elevational view, partly in section and partly broken away, of the side pocket mandrel showing the installation of production tubing and the perforating gun in the side pocket mandrel of FIG. 2.
Figure 4:
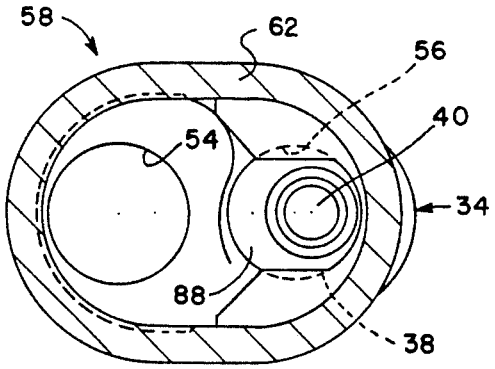
FIG. 4 is a sectional view thereof taken along the line 4—4 of FIG. 3.
Figure 5:
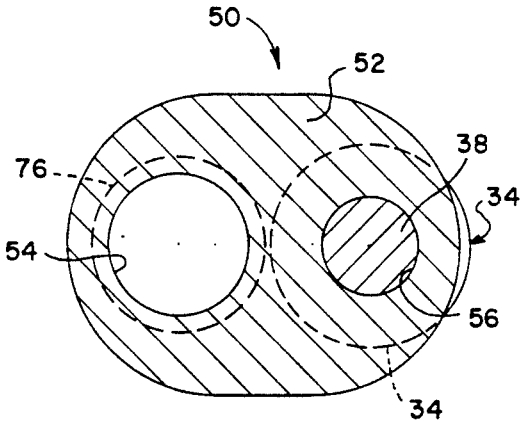
FIG. 5 is a sectional view thereof taken along the line 5—5 of FIG. 3.
Figure 6:
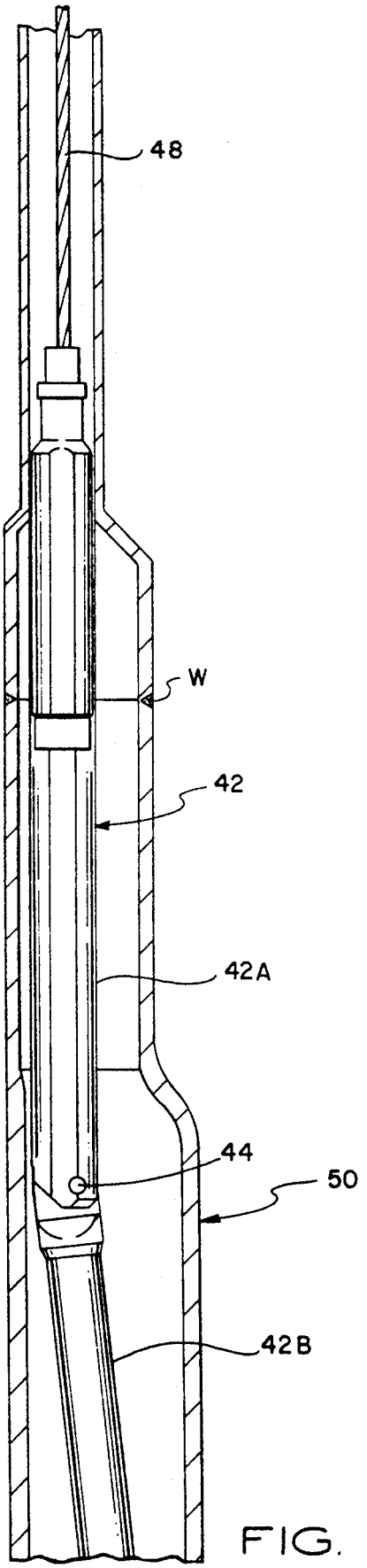
FIGS. 6 and 7 are longitudinal sectional views of the side pocket mandrel showing actuation of the perforating gun detonator by a kickover tool.
Figure 7:
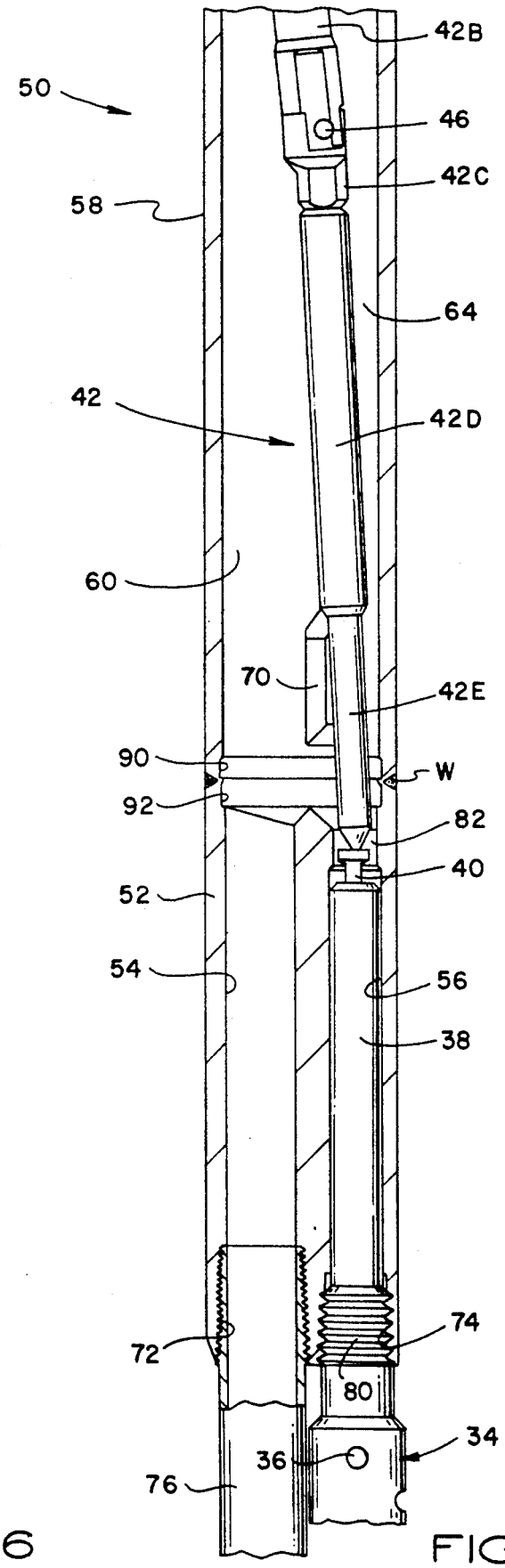
Figure 8:
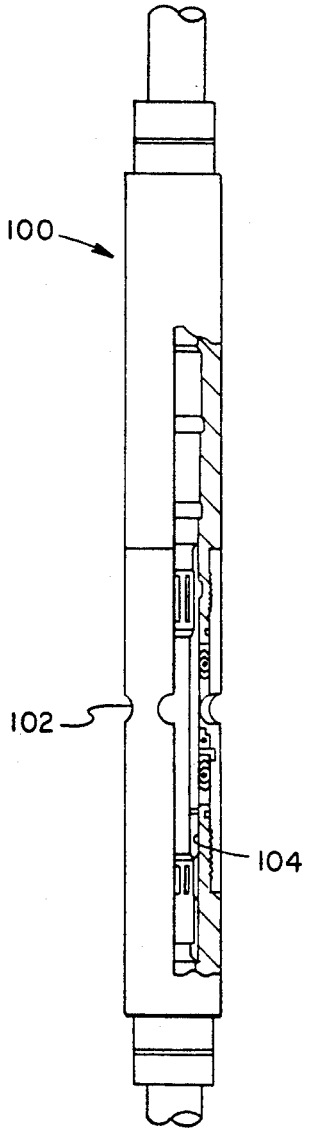
FIG. 8 is an elevational view, partly in section, of the sliding side door circulation tool shown in FIG. 1.
Figure 9:
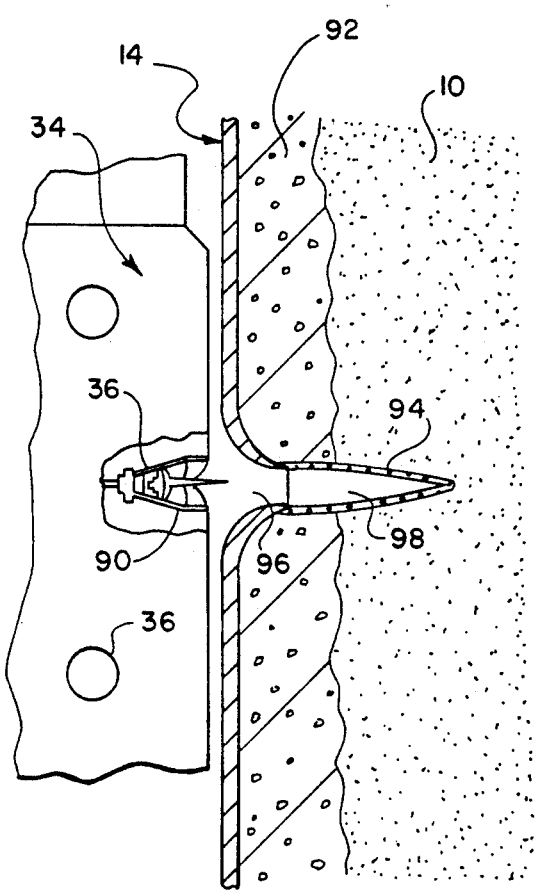
FIG. 9 is an elevational view, partly broken away and partly in section, illustrating penetration of the well casing, cement lining and surrounding formation by the shaped charge of a jet perforator gun.

The perforating gun assembly 26 is equipped with a gun mandrel 34 which includes an array of shaped charge jet-type perforating guns 36. Referring now to FIG. 3 and FIG. 8, the perforating gun is equipped with a mechanical detonator 38 which includes a firing pin 40 which is engagable by a kickover tool 42, as shown in FIG. 7.

The kickover tool 42 includes a tool body 42A, an intermediate arm 42B and a threaded connector 42C. A spacer sub 42D is jointed in a threaded union with the connector 42C. The intermediate arm 42B is pivotally connected to the tool body 42A by a pin 44. Likewise, the lower spacer sub 42D is pivotally coupled to the intermediate arm 42B by a hinge pin 46. The tool body 42A is attached to a wire line 48 and is suspended from a wire line service truck at the surface. The kickover tool 42 is reciprocated to obtain insertion of the kickover tool into the side pocket receptacle bore of a side pocket mandrel 50. The lower spacer sub 42D has a terminal pin portion 42E which is engagable with firing pin 40 to produce detonation. After detonation, the kickover tool 42 is retrieved from the side pocket mandrel, and is thereafter retrieved to the surface.

Figure 2:
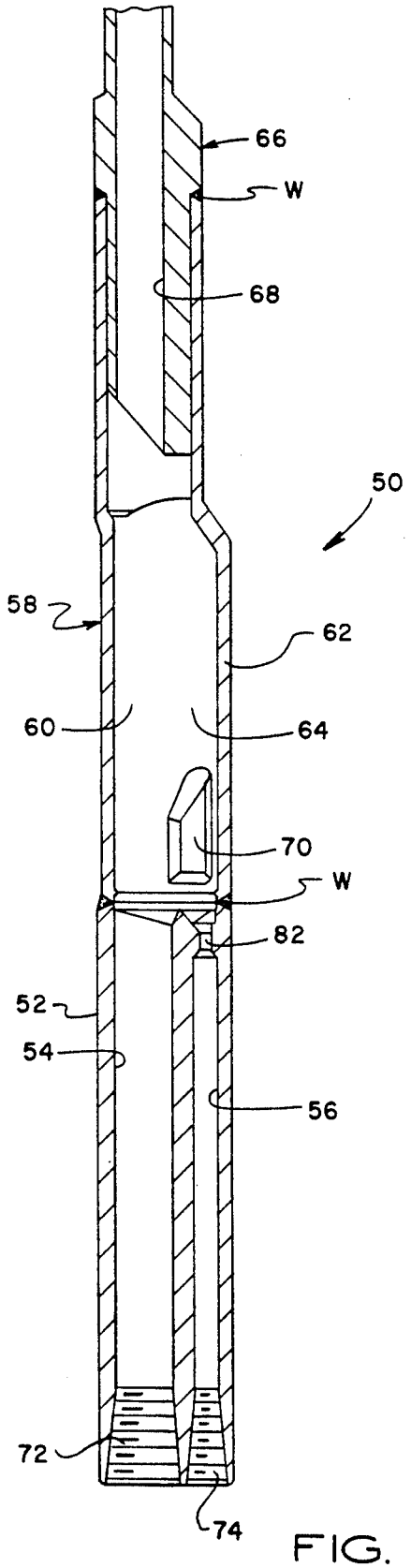
FIG. 2 is a longitudinal sectional view of a side pocket mandrel in which the perforating gun of FIGURE is installed.

Referring now to FIG. 2, the side pocket assembly 50 includes an elongate pocket section 52 which is intersected by a longitudinal production bore 54 and by an offset receptacle bore 56 which extends alongside the production bore 54. The side pocket mandrel assembly also includes an upper body section 58 attached to mandrel body 52 by a butt weld W. The upper body section 58 has a main passage 60 formed in alignment with the production bore of the side pocket mandrel body, and has an offset sidewall 62 forming a belly chamber 64 for receiving spacer sub 42C of the kickover tool 42. The belly chamber 64 thus provides access to the kickover tool for insertion into the receptacle bore 56. Attached to the upper body section is a connecting sub 66 which is attached to the upper body member 58 by a butt weld W. The connecting sub 66 has a bore 68 which is aligned with the production bore 54 of the side pocket mandrel 52. A deflector recess 70 is formed in the offset sidewall 62 for guiding the spacer sub 42D into striking engagement with the firing pin 40, as shown in FIG. 7.

The lower end of the side pocket mandrel body 52 is fitted with internal box threads 72, 74. An intermediate production tubing string 76 is fitted with a threaded pin connector 78 which is received in threaded engagement within the threaded box connector 72. Likewise, the gun mandrel 34 has a threaded end portion 80 which is received in threaded engagement with the threaded box connector 74. Thus, the gun mandrel 34 is attached to the lower end of the side pocket mandrel body 52 with its detonator 38 being received within the side pocket receptacle bore 56. As can best be seen in FIG. 3 and FIG. 7, the firing pin is received within a radially stepped bore 82 which opens into the belly chamber 64. According to this arrangement, the firing pin 40 is protected against inadvertent actuation during run in and handling. The spacer sub of the kickover tool 42 is kicked over into the belly chamber 64 for insertion into the protective stepped bore 82 by reciprocation of the wire line 48 to cause the upper arm section 42B to kick over and place the spacer sub 42C into position for insertion into the protected firing pin bore 82.

Referring now to FIG. 8, upon detonation, the shaped charge jet gun 36 produces a high temperature, high pressure plasma jet 90 which penetrates the well casing 14, the protective cement layer 92 and the surrounding cement layer and formation. It compacts the material, thereby producing a sealed cone 94 which blocks the newly formed casing perforation 96. If the shoot is conducted in an overbalanced well bore condition, then fluids, including mud and debris from the well bore, will be forced outwardly into the formation perforation tunnel 98 and will immediately plug the casing perforation 96.

Accordingly, the shoot is preferably performed with the well in an underbalanced pressure condition relative to the surrounding formation. With a high pressure differential, the pressure surge from the surrounding formation will break up the compacted cone 94 and sweep it back in the well bore where it will be flowed to the surface. As the compacted cone fragments are swept away, the casing perforation 96 is cleaned and cleared for maximum inflow. Moreover, any mud and debris will also be swept away from the perforation opening and flowed to the surface.

After the well casing has been perforated, a circulation/production access tool 100 which is connected within the production tubing string 18 is opened to provide flow access into the production tubing. The circulation/production access tool 100 includes circulation ports 102 which can be opened and closed by the sidewall of a tubular, slidable sleeve 104. Such a circulation/production access tool is offered by Otis Engineering Corporation under the registered trademark SLIDING SIDE DOOR$^R$, and is described in Otis Engineering Corporation brochure OEC 5441. Should one of the production zones start producing water, the production tubing can be isolated with respect to the water producing zone by closing the circulation tool without effecting production in the remaining producing zones.

The invention has been described with reference to an exemplary embodiment, and in connection with a vertical bore gas well. It will be appreciated that the apparatus of the present invention may be used to good advantage in connection with slant as well as horizontal well completions. Various modifications of the disclosed embodiments as well as alternative well completion applications of the invention will be suggested to persons skilled in the art by the foregoing specification and illustrations. It is therefore contemplated that the appended claims will cover any such modifications or embodiments as may fall within the true scope of the invention.

What is claimed is:

1. Apparatus for perforating a well casing comprising, in combination:

a side pocket mandrel including an elongate mandrel body intersected by a longitudinal production bore and by an offset receptacle bore extending alongside the production bore, an upper body section attached to the upper end of said mandrel body, said upper body section having a main passage formed therethrough in alignment with the production bore and having an offset sidewall forming a belly chamber for receiving a kickover tool, said belly chamber providing kickover tool access to the receptacle bore, said upper body section having means for connecting its upper end to a tubing string, and the side pocket mandrel having means for connecting its lower end to a tubing string; and, a perforator tool including a gun mandrel attached to the lower end of said side pocket mandrel body and having detonator means disposed within the side pocket receptacle bore, said detonator means being disposed for striking engagement by a kickover tool.

2. Apparatus for completing a well of the type having a tubular well casing extending through an earth formation comprising, in combination:

a production tubing string adapted for insertion through the bore of the well casing;

a flow circulation tool having a production bore connected in alignment with the bore of the production tubing string;

a side pocket mandrel having a mandrel body connected to the production tubing string, said side pocket mandrel body being intersected by a longitudinal production bore disposed in alignment with the bore of the production tubing string and being intersected by a receptacle bore extending alongside the production bore, said side pocket mandrel body having an offset sidewall forming a belly chamber above the receptacle bore for receiving a kickover tool and guiding the kickover tool for insertion into the receptacle bore;

a perforator tool including a gun mandrel attached to the lower end of the side pocket mandrel body and having detonator means disposed within the side pocket receptacle bore, said detonator means being adapted for actuation in response to striking engagement by a kickover tool; and, a packer having a production bore connected in alignment with the bore of the production tubing string, said packer being adapted for sealing the annulus between the production tubing and the well casing at a location intermediate the flow circulation tool and the surface.

3. Apparatus for perforating a well casing in which production tubing string is suspended comprising, in combination:

an elongate tubular body having a side pocket mandrel adapted for attachment to the production tubing string, said body having a production bore adapted for alignment with the bore of the production tubing string and having an offset, internal receptacle bore for receiving a perforator gun detonator; and, a perforator tool including a gun mandrel attached to the lower end of said side pocket mandrel and having a detonator disposed within the offset receptacle bore, said detonator being adapted for actuation in response to striking engagement by kickover tool inserted into said offset receptacle.

4. A method for perforating a well casing in a well having a well casing extending from the surface to a subsurface producing formation and a production tubing string within the well casing, the production tubing string having a longitudinal flow passage extending therethrough, said method including the steps:

connecting a side pocket mandrel of the type having a longitudinal production bore and an offset receptacle bore to the production tubing string, with the production bore of the side pocket mandrel being aligned with the bore of the production tubing string;

suspending a perforator tool of the type including a gun mandrel and detonator from the lower end of the side pocket mandrel, with the detonator being disposed within the offset receptacle bore; and, running a kickover tool through the production tubing and guiding it for insertion into the offset receptacle bore; and, striking the detonator with the kickover tool.

5. A method for completing a well of the type having a tubular well casing extending from the surface to a subsurface producing formation comprising the steps:

running a production tubing string within the bore of the well casing;

connecting the production bore of a flow circulation tool in alignment with the bore of the production tubing string;

connecting the mandrel body of a side pocket mandrel to the production tubing string with the longitudinal production bore of the side pocket mandrel being aligned with the bore of the production tubing;

attaching the gun mandrel of a perforator tool to the lower end of the side pocket mandrel with the detonator of the perforator tool being received within the side pocket receptacle bore;

setting a packer against the well casing and sealing the annulus between the production tubing and the well casing at a location intermediate the flow circulation tool and the surface;

running a kickover tool on a wire line through the production tubing string, the production packer bore and the production bore of the flow circulation too and guiding the kickover tool for insertion into the receptacle bore of the side pocket mandrel; and, striking the detonator with the kickover tool to cause detonation of a perforator gun mounted on the gun mandrel.

6. A method for completing a well as defined in claim 5, wherein the detonation step is carried out while the well bore is in an underbalanced pressure condition relative to the surrounding earth formation.

* * * * *

UNITED STATES PATENT AND TRADEMARK OFFICE

CERTIFICATE OF CORRECTION

PATENT NO. : 5,224,545

DATED : July 6, 1993

INVENTOR(S) : Flint R. George, Henry L. Restarick, David T. Merritt

It is certified that error appears in the above-indentified patent and that said Letters Patent is hereby corrected as shown below: Column 8, Claim 5, line 55, following "circulation," delete --too-- and insert --tool--.

Signed and Sealed this

Twenty-sixth Day of July, 1994

*Attest:*

*Attesting Officer*

Bruce Lehman

BRUCE LEHMAN

*Commissioner of Patents and Trademarks*